US008678076B2

(12) United States Patent
Shore et al.

(10) Patent No.: US 8,678,076 B2
(45) Date of Patent: Mar. 25, 2014

(54) HEAT EXCHANGER WITH MANIFOLD STRENGTHENING PROTRUSION

(76) Inventors: Christopher R. Shore, Hamilton (CA); Cindy W. Storr, Burlington (CA); John W. Izard, Brampton (CA); Mark S. Kozdras, Oakville (CA)

( * ) Notice: Subject to any disclaimer, the term of this patent is extended or adjusted under 35 U.S.C. 154(b) by 1037 days.

(21) Appl. No.: 11/941,353

(22) Filed: Nov. 16, 2007

(65) Prior Publication Data

US 2009/0126911 A1 May 21, 2009

(51) Int. Cl.
*F28D 1/02* (2006.01)
*F28F 3/00* (2006.01)
*F28F 3/08* (2006.01)

(52) U.S. Cl.
USPC ..... 165/153; 165/166; 165/167

(58) Field of Classification Search
USPC ..... 165/153, 166, 167
See application file for complete search history.

(56) References Cited

U.S. PATENT DOCUMENTS

| | | | | |
|---|---|---|---|---|
| 4,987,955 | A | 1/1991 | Bergqvist et al. | |
| 5,036,911 | A * | 8/1991 | So et al. | 165/153 |
| 5,184,673 | A | 2/1993 | Hedman et al. | |
| 5,369,883 | A * | 12/1994 | So et al. | 29/890.039 |
| 5,538,077 | A * | 7/1996 | So et al. | 165/109.1 |
| 5,634,518 | A | 6/1997 | Burgers | |
| 5,638,900 | A | 6/1997 | Lowenstein et al. | |
| 5,794,691 | A * | 8/1998 | Evans et al. | 165/153 |
| 6,170,567 | B1 | 1/2001 | Nakada et al. | |
| 6,478,080 | B2 * | 11/2002 | Pinto | 165/153 |
| 6,497,274 | B2 | 12/2002 | Cheadle | |
| 6,837,305 | B2 * | 1/2005 | Zurawel et al. | 165/153 |
| 6,889,758 | B2 * | 5/2005 | Burgers et al. | 165/148 |
| 2002/0050347 | A1 | 5/2002 | Hanley et al. | |
| 2005/0082049 | A1 | 4/2005 | Brost | |
| 2006/0032621 | A1 | 2/2006 | Martin et al. | |
| 2006/0048917 | A1 | 3/2006 | Persson | |

FOREIGN PATENT DOCUMENTS

| | | |
|---|---|---|
| GB | 859837 | 1/1961 |
| JP | 2000018872 A | 1/2000 |
| WO | 2006083446 A2 | 8/2006 |

* cited by examiner

*Primary Examiner* — Mohammad M Ali
*Assistant Examiner* — Ian Soule
(74) *Attorney, Agent, or Firm* — Ridout & Maybee LLP

(57) ABSTRACT

A plate type heat exchanger having a plurality of stacked plate pairs made up of first and second plates. Each plate pair has opposed manifold members that form respective inlet and outlet manifolds for the flow of a first fluid through a first set of fluid channels formed by the plate pairs. The manifold members space the plate pairs apart to form a second set of transverse flow channels for the flow of a second fluid. A protrusion member is formed at an end portion of the plates and proximal to each of the manifold members and has a mating surface, such that the protrusion members on the second plate of one plate pair align and abut with the protrusion members on the first plate of an adjacent plate pair thereby reinforcing and strengthening the manifold region of the heat exchanger to prevent deformation of the manifold under pressure.

14 Claims, 14 Drawing Sheets

HEAT EXCHANGER WITH MANIFOLD STRENGTHENING PROTRUSION

FIELD OF THE INVENTION

This invention relates to heat exchangers, and in particular to stacked plate heat exchangers as used particularly in the automotive industry.

BACKGROUND OF THE INVENTION

Stacked plate heat exchangers typically comprise a plurality of plate pairs stacked one on top of the other with each plate pair having opposed inlet and outlet openings such that when the plate pairs are stacked together, the inlet and outlet openings align to form inlet and outlet manifolds and thereby establish communication between fluid channels formed inside each plate pair. The plate pairs are usually joined together by brazing. However, as the plate pairs tend to be unsupported in the area of the manifolds, the heat exchanger in the area of the inlet and outlet openings tends to distort under the pressure of the fluid flowing therethrough and will often expand like an accordion or "bellows" in the manifold region. The distortion that occurs in the manifold regions of the heat exchanger tends to lead to premature failure or cracking and leaking in the heat exchanger.

One approach used to reinforce the inlet and outlet areas of a heat exchanger is to use exterior clamps or brackets that are brazed to the outside of the heat exchanger to keep it from expanding under pressure. Another approach is to insert perforated or slotted tubes through all of the aligned inlet and outlet openings of each plate, the tubes being brazed to the peripheries of the respective inlet and outlet openings. Yet another common approach is to use a large area washer or reinforcing plate to space the plate pairs apart and to create the fluid communication between the fluid channels formed by the plate pairs. The additional surface area provided by the large area washer or reinforcing plate provides additional support to the typically unsupported area between plate pairs; however, these types of washers can be costly and therefore increase overall manufacturing costs associated with the particular heat exchanger.

U.S. Pat. No. 5,794,691 (Evans et al.) discloses a heat exchanger made from a plurality of stacked plate pairs wherein the inlet and outlet openings that form the manifolds include opposed flange segments formed on the inner peripheral edges of the openings. The flange segments extend inwardly and are joined together when the plates are stacked together to prevent expansion of the manifolds when under pressure.

SUMMARY OF THE INVENTION

In the present invention, a protrusion member is formed in the peripheral region of the plates of a stacked-plate heat exchanger in proximity to the manifold region to improve the overall ability of the manifold to withstand the high fluid pressures that are frequently encountered in these types of heat exchanger systems as well as to improve the overall efficiency of the heat exchanger by preventing undesirable bypass flow.

According to one embodiment of the invention, there is provided a heat exchanger comprising a plurality of stacked plates arranged in face-to-face plate pairs. Each of the plate pairs includes first and second plates, the first plate having a central planar portion, and a peripheral edge portion extending from the central planar portion to an outer edge. The second plate of each face-to-face plate pair having a central planar portion spaced apart from the central planar portion of the first plate, a peripheral edge portion extending from the central planar portion to an outer edge, the peripheral edge portion of the second plate mating with the peripheral edge portion of the first plate thereby defining a first set of fluid channels between the spaced-apart central planar portions for the flow of a first fluid therethrough. Opposed manifold members space apart one plate pair from an adjacent plate pair and establish fluid communication between the first set of fluid channels formed between the spaced-apart central planar portions in each of the plate pairs thereby forming respective inlet and outlet manifolds. The manifold members being inwardly disposed from respective ends of the first and second plates and further defining a second set of fluid channels between adjacent plate pairs for the flow of a second fluid through the heat exchanger, the second set of fluid channels being transverse to the first set of fluid channels. The first and second plates further including a protrusion member located proximal to each of the manifold members. The protrusion member being spaced-apart from the respective manifold member by a predetermined distance and having a mating surface so that the protrusion members on the second plate of one plate pair align and mate with the protrusion members of the first plate of the adjacent plate pair when said plate pairs are stacked together thereby supporting said plate pairs in their spaced-apart relationship.

BRIEF DESCRIPTION OF THE DRAWINGS

Embodiments of the invention will now be described, by way of example, with reference to the accompanying drawings, in which.

DETAILED DESCRIPTION OF THE PREFERRED EMBODIMENTS

Figure 1:
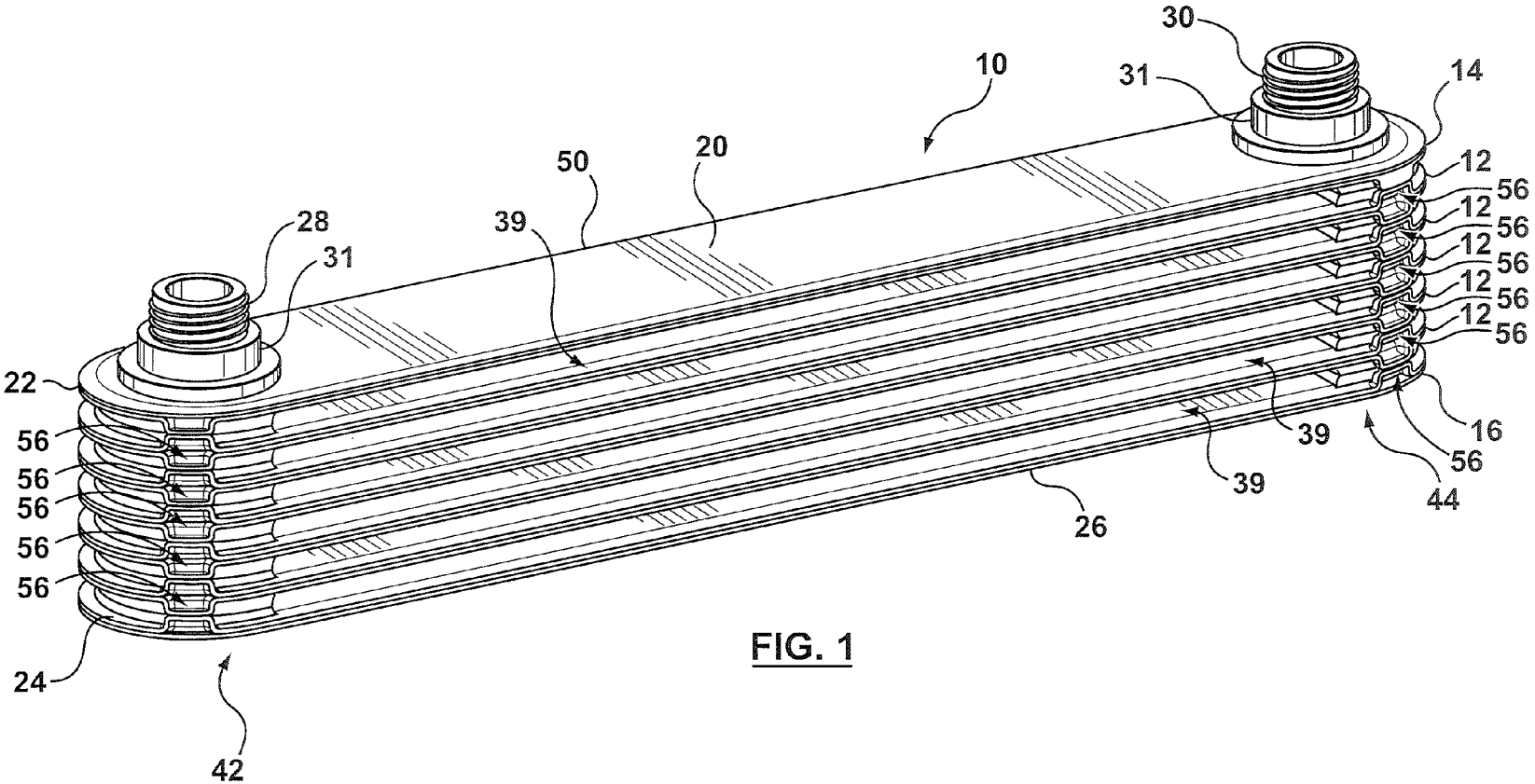
FIG. 1 is a perspective view of an embodiment of the heat exchanger according to the present invention.

Referring to the drawings, there is shown in FIG. 1 a heat exchanger 10 according to one embodiment of the present invention. Heat exchanger 10 is formed of a plurality of stacked plate pairs 12, a top plate pair 14 and a bottom plate pair 16. Each plate pair 12 is identical and is comprised of first and second plates 18, 19. First and second plates 18, 19 are identical to each other and are arranged in a face-to-face relationship so that the second plate 19 is upside down with respect to the first plate 18. Top plate pair 14 is comprised of a first top plate 20 and a second plate 22 which is the same as one of the second plates 19 that form part of plate pairs 12. Bottom plate pair 16 has a first plate 24 which is the same as the first plate 18 that forms part of the plate pairs 12 and a bottom plate 26. Top plate 20 of the top plate pair 14 is generally a plain, flat plate having opposed openings or ports 31 formed therein for receiving inlet and outlet fittings or nipples 28, 30. The inlet and outlet fittings 28, 30 allow for the flow of a first fluid through the heat exchanger 10. Bottom plate 26 of the bottom plate pair 16 is similar to the top plate 20 in that it is generally a plain, flat plate; however, the bottom plate 26 is formed without any openings so as to close the heat exchanger 10.

While the inlet and outlet fittings 28, 30 are shown as being mounted in the top plate 20, it will be understood that the inlet and outlet fittings 28, 30 could instead be mounted in the bottom plate pair 16 with the top plate 20 of the top plate pair 14 serving to close the heat exchanger. In another configuration, the top plate 20 and bottom plate 26 could be formed so that one fitting is mounted in the top plate 20 and the other fitting mounted in the bottom plate 26. Accordingly, various configurations of the heat exchanger 10 are contemplated and can be adjusted depending on the particular application or design requirements.

Figure 2:
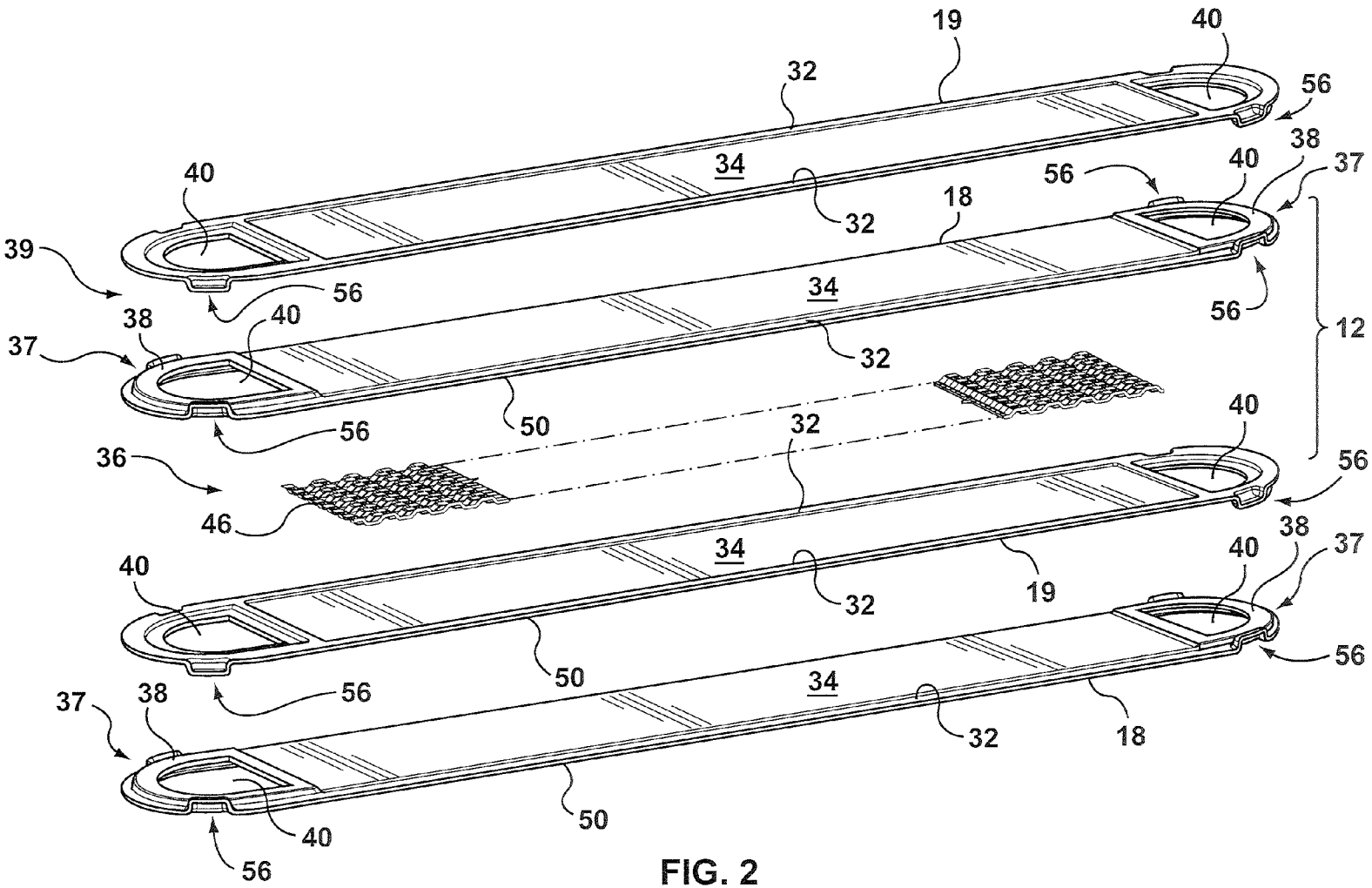
FIG. 2 is an exploded perspective view of a subassembly of the heat exchanger of FIG. 1.

Referring now to FIG. 2, a subassembly of plate pairs 12 is shown in exploded perspective view. As mentioned above, each plate pair 12 is made up of first and second plates 18, 19 which are stacked face-to-face so that the second plate 19 is upside down with respect to the first plate 18. Each plate 18, 19 has a peripheral edge portion 32 and a raised central planar portion 34 which projects out of the plane of the peripheral edge portion 32, the peripheral edge portion extending from the central planar portion to an outer edge 50 of the plate 18, 19. However, it will be understood that since second plate 19 is arranged upside down with respect to the first plate 18, the central planar portion 34 of the second plate 19 is seen as projecting below the plane of the peripheral edge portion 32. When the plates 18, 19 are stacked in their face-to-face relationship, the peripheral edge portions 32 join together forming a seal, and the central planar portions 34 are spaced-apart from each other thereby defining a fluid channel 36 therebetween for the flow of the first fluid.

Figure 7:
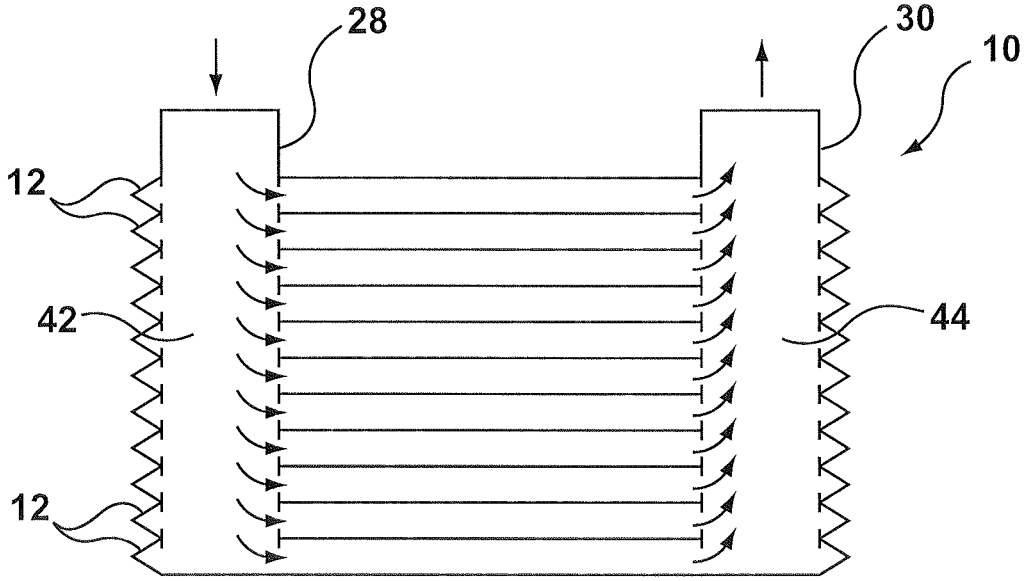
FIG. 7 is a diagrammatic view of the heat exchanger of FIG. 1 illustrating the flow of fluid through the individual plate pairs making up the heat exchanger.

When the plate pairs 12 are stacked together, they are spaced-apart from each other by means of manifold members 37. The manifold members 37 are typically located at opposed ends of the heat exchanger plates 18, 19, and are inwardly disposed from the ends thereof. The manifold members 37 establish fluid communication between the first set of fluid channels 36 formed between the central planar portions 34 of the plates 18, 19 in each of the plate pairs 12, thereby forming respective inlet and outlet manifolds 42, 44 for the flow of the first fluid through the heat exchanger 10. The flow of the first fluid through the heat exchanger is diagrammatically represented in FIG. 7. As shown, fluid enters the inlet manifold 42 and passes through the plate pairs 12 into the outlet manifold 44.

As mentioned above, the manifold members 37 also space the plate pairs 12 apart when they are stacked together and thereby form a second set of flow channels 39 between the plate pairs 12 for the flow of a second fluid through the heat exchanger 10, the second set of flow channels 39 being transverse to the first set of flow channels 36. In the case where the heat exchanger 10 is used as an oil cooler, it will be understood that the first fluid would be engine or transmission oil, for example, while the second fluid would be water or any other suitable coolant such as ethylene glycol. It will also be understood that heat exchanger 10 may be used for applications other than as an oil cooler. Accordingly, the first and second fluids could be any of a number of fluids. For example, applications are contemplated wherein the first fluid is water or coolant, while the second fluid is air.

In the subject embodiment, the manifold members 37 are in the form of spaced-apart end bosses 38 which are integrally formed in the central planar portions 34 of each of the plates 18, 19. As shown, the end bosses 38 are raised out of the plane of the corresponding central planar portion 34 and have openings 40 formed therein for providing fluid access to the fluid channels 36 formed between the spaced-apart central planar portions 34 of the plates 18, 19. Therefore, when the plate pairs 12 are stacked together to form the heat exchanger 10, the end bosses 38 and their openings 40 align and are in fluid communication with each other thereby forming the inlet and outlet manifolds 42, 44. While manifold members 37 in the form of end bosses 38 are discussed in connection with the subject embodiment, it will be understood that many different forms of manifold members 37 may be used in connection with the subject invention. For instance, manifold members 37 in the form of washers, tubular members, spacing plates, etc. may be used. Some of these structures will be further described below in connection with additional example embodiments of the present invention.

As shown in FIG. 2, a fin or turbulizer 46 is located inside each plate pair 12, i.e. in each fluid channel 36. Turbulizers 46 are also located inside the top and bottom plate pairs 14, 16. Turbulizer 46 is a strip of expanded metal. In one embodiment, the turbulizer 46 is formed with parallel rows shaped in a sinusoidal, staggered configuration, although other configurations could be used, as desired. The length of the turbulizer 46 generally corresponds to the length of the plate central planar portions 34 between the manifold members 37, and the width of the turbulizer 46 generally corresponds to the distance between the peripheral edge portions 32. The thickness of the turbulizer 46 is such that after the plate pairs 12 are assembled and the heat exchanger 10 is joined together, such as by brazing, the plate central portions are joined to and in good thermal contact with the turbulizer 46. While the length of the turbulizer has been described as, generally, being the length of the central planar portions 34 of the plates 18, 19 between the manifold members, turbulizers 46 that extend the entire length of the first set of fluid channels 36 formed between the plates 18, 19 may also be used. In the latter case, the turbulizer 46 may have openings formed therein that align with the openings 40 formed corresponding manifold members 37 as a means for reducing/preventing pressure drop associated with the first fluid entering the fluid channels 36.

Cooling fins (not shown) could be located in the second set of flow channels 39 formed between adjacent plate pairs 12. The cooling fins that are typically used are corrugated cooling fins having transverse undulations or louvres formed therein to increase heat transfer. However, any type of cooling fin could be used in the present invention or even no cooling fin at all, if desired.

Figure 3:
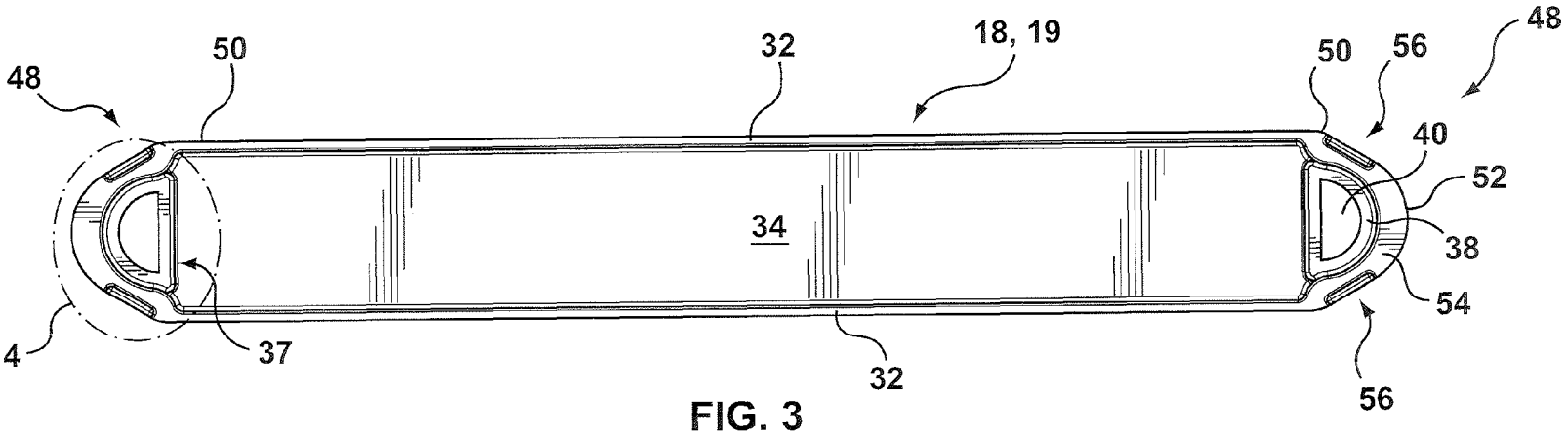
FIG. 3 is a top view of the upper heat exchanger plate of plate pair 12 of the subassembly shown in FIG. 2.
Figure 12:
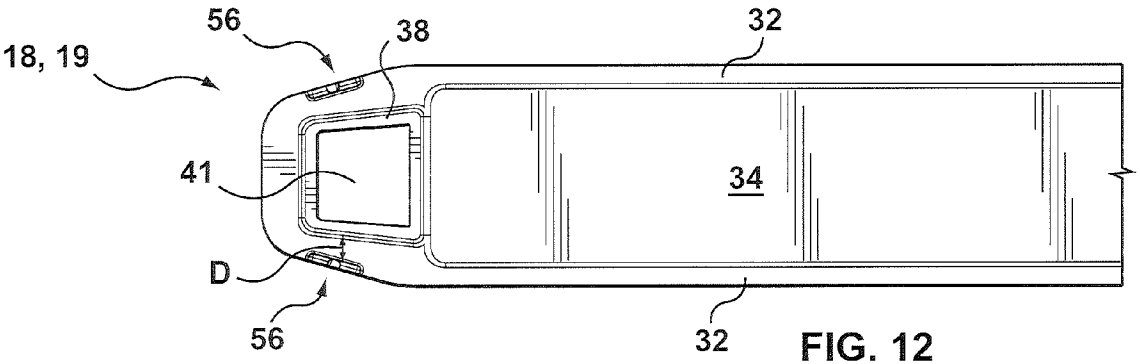
FIG. 12 is a top view or waterside view of a heat exchanger plate according to another embodiment of the invention.

The structure of the first and second plates 18, 19 that make up plate pairs 12 of the subject embodiment will now be described in further detail. As shown more clearly in FIGS. 3 and 4, plates 18, 19 have end portions 48, one of which is shown in the encircled area 4 in FIG. 3. In the end portions 48 of the subject embodiment, the outer edge 50 of the peripheral edge portions 32 of plate 18, 19 tapers inwardly from adjacent the central planar portion 34 towards rounded ends 52. The end bosses 38, which are formed at the respective ends of the central planar portion 34, are inwardly spaced from the outer edge 50 and from the rounded tips or ends 52 of the plate 18, 19. Accordingly, the portion 54 of the peripheral edge portion 32 that extends into the end portions 48 of the plates 18, 19 may be greater in width than the peripheral edge portions 32 that extend on either side of the central planar portion 34. As well, while the end bosses 38 are shown as having D-shaped openings 40, it will be understood that any shaped opening could be used, as desired. For example, the openings could be formed as round or trapezoidal ports. See for instance the trapezoidal shaped opening 41 shown in FIG. 12.

Figure 5:
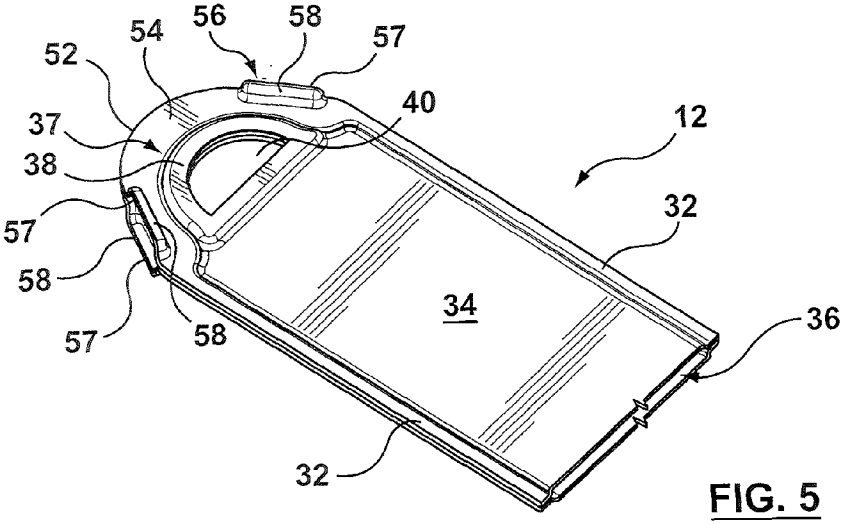
FIG. 5 is a partial perspective view of a portion of part of the assembled subassembly shown in FIG. 2.
Figure 6:
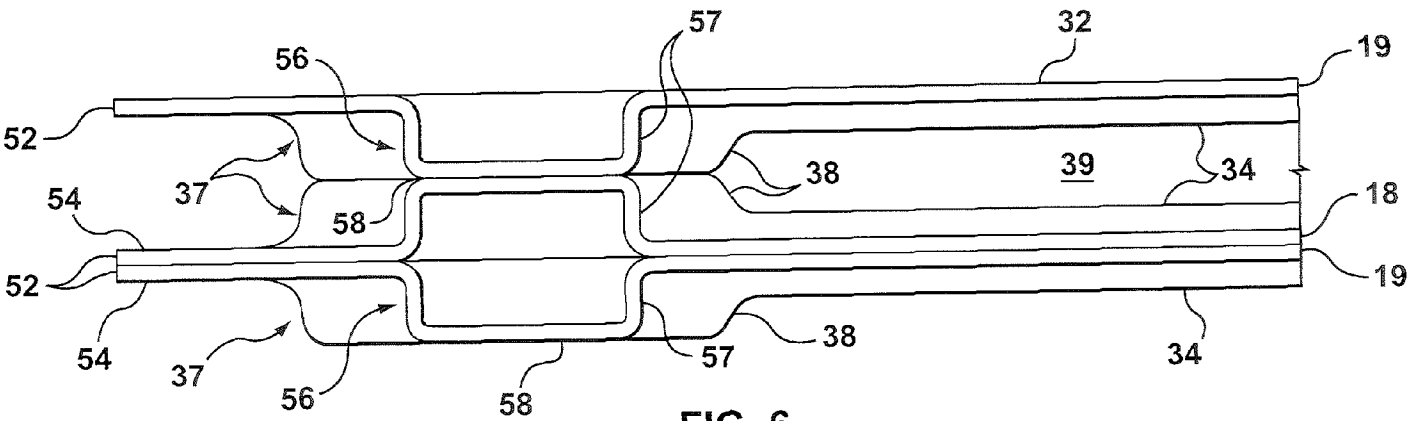
FIG. 6 is a partial elevation view of the assembled subassembly shown in FIG. 2.

As shown more clearly in FIGS. 5 and 6, the peripheral edge portions 54 of the end portions 48 of the plates 18, 19 include a protrusion member 56 that is formed along the outer edge 50 of the plates 18, 19 on either side of the D-shaped opening 40 of the end bosses 38. In the subject embodiment, the protrusion member 56 is in the form of a half-dimple 57, however, it will be understood that the protrusion member 56 may be one of a number of formats including, but not limited to, a half-dimple, a rib, a stepped-flange or flange extension, etc., and in some embodiments may have either flat or rounded mating surfaces 58. Some of the above-mentioned formats of the protrusion member 56 will be described in further detail below in connection with other example embodiments of the present invention.

Figure 4:
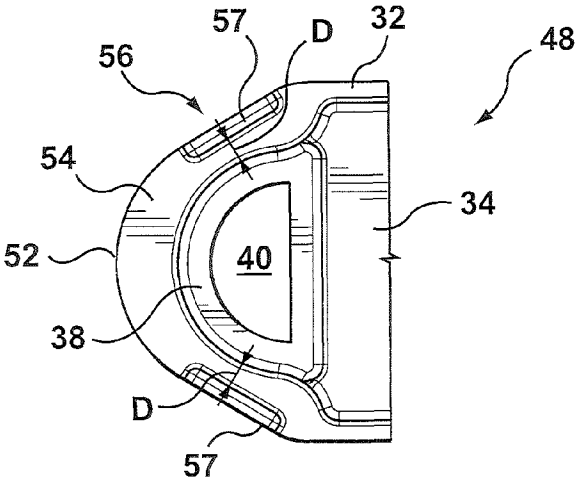
FIG. 4 is a detail top view of the encircled area shown in FIG. 3.

In the embodiment shown in FIGS. 5 and 6, the protrusion member 56 or half-dimple 57 projects out of the plane of the peripheral edge portion 54 and is spaced-apart from the adjacent end boss 38 by a distance D (see FIG. 4). The distance D is selected to ensure that adequate support or reinforcement is provided to the manifold regions of the heat exchanger 10.

The half-dimple 57 has a generally flat mating surface 58 which, in this embodiment, lies in the same plane as the raised end bosses 38 of the plates 18, 19. Accordingly, when the plates 18, 19 are stacked in their face-to-face relationship, the half-dimples 57 on each plate 18, 19 align in such a way that they project in opposite directions. Therefore, when the plate pairs 12 are stacked together to form the heat exchanger 10, the mating surface 58 of the half-dimple 57 on the second plate 19 of a first plate pair 12 comes into surface-to-surface contact with the mating surface 58 of the half-dimple 57 on the first plate 18 of the adjacent plate pair 12 (see FIG. 6).

When the stacked plate pairs 12 are joined together by brazing, for example, the mating half-dimples 57 or protrusion members 56 provide an additional area of surface contact between the adjacent plate pairs 12 in the unsupported area of the stacked plate pairs 12. The additional surface contact between the plate pairs 12 provides an additional brazing surface between the plate pairs 12 proximal to the manifold regions (i.e. the inlet and outlet manifolds 42, 44). The added surface area for brazing located proximate to the manifolds 42, 44 provides additional support to the end portions 48 of the plate pairs 12 which strengthens the structure of the heat exchanger 10 in a region that is typically prone to failure or cracking. As well, the external position of the protrusion members 56 allows for a visual check or inspection during the manufacturing process to ensure that a proper joint between protrusion members 56 has been achieved between the plate pairs 12 after brazing. Therefore, any flaws or defects with the connection between the protrusion members 56 can be easily detected as the additional brazing surface is located on the outside of the heat exchanger 10, thereby increasing the overall quality control associated with the manufacture of the heat exchanger 10.

While the half-dimple 57 type of protrusion member 56 has been described as having a generally flat mating surface, it has been found that initially forming the half-dimple 57 in the plates 18, 19 with a slightly rounded or dome-shaped mating surface 58 tends to facilitate the brazing process as the mating surfaces 58 will deform or compress under loading and collapse to a flat surface during the brazing process. Therefore, it will be understood that reference to the generally flat mating surfaces 58, is intended to encompass an initially rounded surface that deforms or collapses to flat during the manufacturing process.

Figure 8:
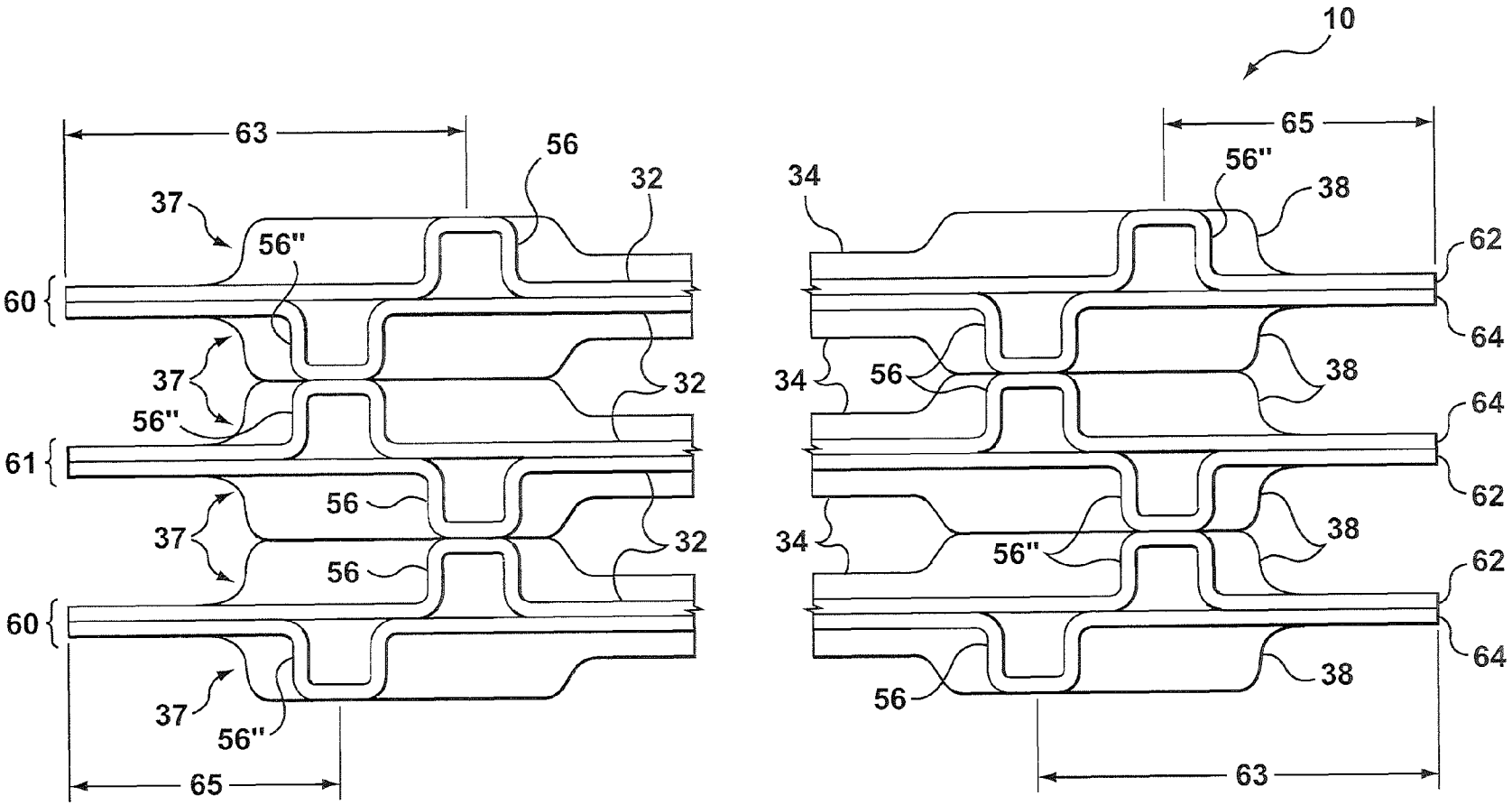
FIG. 8 is a partial elevation view of a subassembly of the heat exchanger according to another embodiment of the invention.

Referring now to FIG. 8, there is shown another embodiment of the invention. In this embodiment, the heat exchanger 10 is comprised of alternating stacked plate pairs 60 and 61. Plate pairs 60 are comprised of first and second plates 62, 64 which are similar in structure to the plates 18, 19 described above. Accordingly, first and second plates 62, 64 have peripheral edge portions 32, raised central planar portions 34 with spaced-apart manifold members 37 in the form of opposed end bosses 38, and half-dimple 57 type protrusion members 56 formed in the peripheral edge portions 32 of the plates on either side of the end bosses 38. However, in this embodiment, the protrusion members 56 located at one end of the plate 62 are formed in a first position 63 with respect to the corresponding end of the plate 62, while the protrusion members 56" located at the opposite end of the plate 62 are formed in a second position 65 with respect to the corresponding end of the plate wherein the first position 63 corresponds to the distance from the corresponding end of the plate 62 to the centre of the protrusion member 56 while the second position 65 corresponds to the distance from the corresponding end of the plate 62 and the centre of the protrusion members 56", the first distance being greater than the second distance. The second plate 64 is identical to the first plate 62, however it is placed upside-down and rotated 180 degrees with respect to the first plate 62 to form plate pair 60. As a result of the inverted and rotated relationship between the first and second plates 62, 64, the protrusion members 56, 56" on the first plates 62 are laterally offset with respect to the protrusion members 56, 56" on the second plates 64. Plate pairs 61 are similar to the first set of plate pairs 60 described above as they too are made up of mating first and second plates having peripheral edge portions 32, raised central planar portions 34 and spaced-apart end bosses 38. However, the first plate of plate pair 61 corresponds to the second plate 64 of the first plate pair 60 placed upside down with respect thereto, and the second plate of plate pair 61 corresponds to the first plate 62 of the plate pair 60 placed upside down with respect thereto. Accordingly, plate pairs 61 are in fact identical to the plate pairs 60 except for being positioned upside down with respect the adjacent plate pair 60. Therefore, when the plate pairs 60, 61 are alternatingly stacked together, the end bosses 38 and protrusion members 56, 56" on the second plate 64 of the first plate pair 60 abut and align with the end bosses 38 and protrusion members 56, 56" of an inverted plate 64 of the adjacent plate pair 61.

Figure 9:
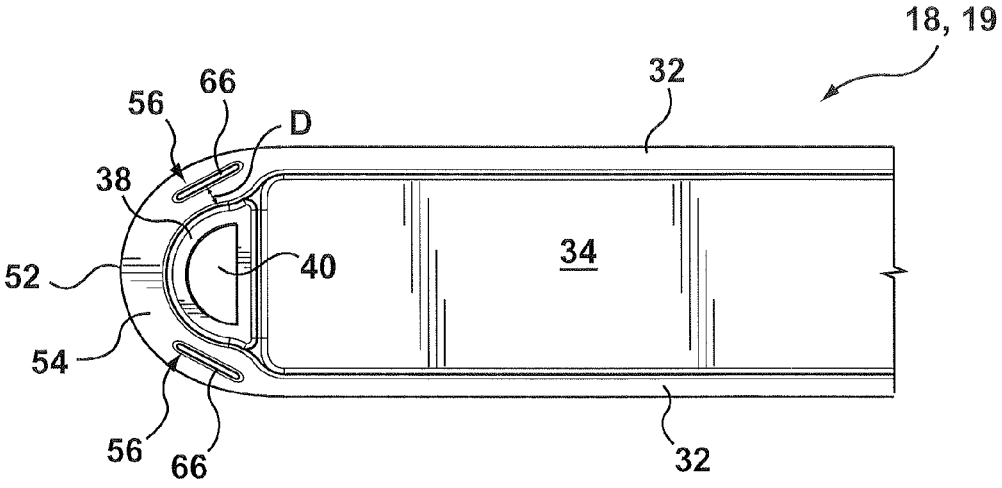
FIG. 9 is a top view of an upper heat exchanger plate of a plate pair according to another embodiment of the invention.

FIG. 9 shows another embodiment of the invention that is similar in structure to the heat exchanger shown in FIGS. 1-6, however, in this embodiment the first and second plates 18, 19 have protrusion members 56 in the form of elongated ribs 66 formed in the peripheral edge portion 54 of the end portion 48 of the plates 18, 19. When the plate pairs 12 are stacked together, the ribs 66 of adjacent plate pairs 12 align and abut with each other so as to provide an additional mating surface between the plate pairs 12. While the ribs 66 are shown as being generally linear, the ribs 66 could be curvilinear so as to mimic the shape of the D-shaped opening 40. As well, while only two ribs 66 are shown, one on either side of the manifold member 37 or end boss 38, a third rib (not shown) could be formed along the rounded end or tip 52 of the end portion 48 of the plates 18, 19. In fact, there may be as many ribs 66 formed in the peripheral edge portion 54 as is desirable based on the manufacture and intended application of the heat exchanger 10. As well, rather than forming a plurality of ribs 66 in the peripheral edge portion 54 of the plates 18, 19, a single, curvilinear rib could be formed around the periphery of the opening 40 in each of the plates 18, 19. Accordingly, it will be understood that various configurations employing the rib-shaped protrusion members 66 are contemplated by the present invention.

Once again, the ribs 66 are spaced the predetermined distance D from the outer edge of the corresponding manifold member 37 or end boss 38 so as to ensure the optimal relationship between providing adequate support to the manifold region of the heat exchanger while ensuring that a sufficient amount of peripheral edge portion 54 is provided to form a proper seal between the plates 18, 19.

Figure 10:
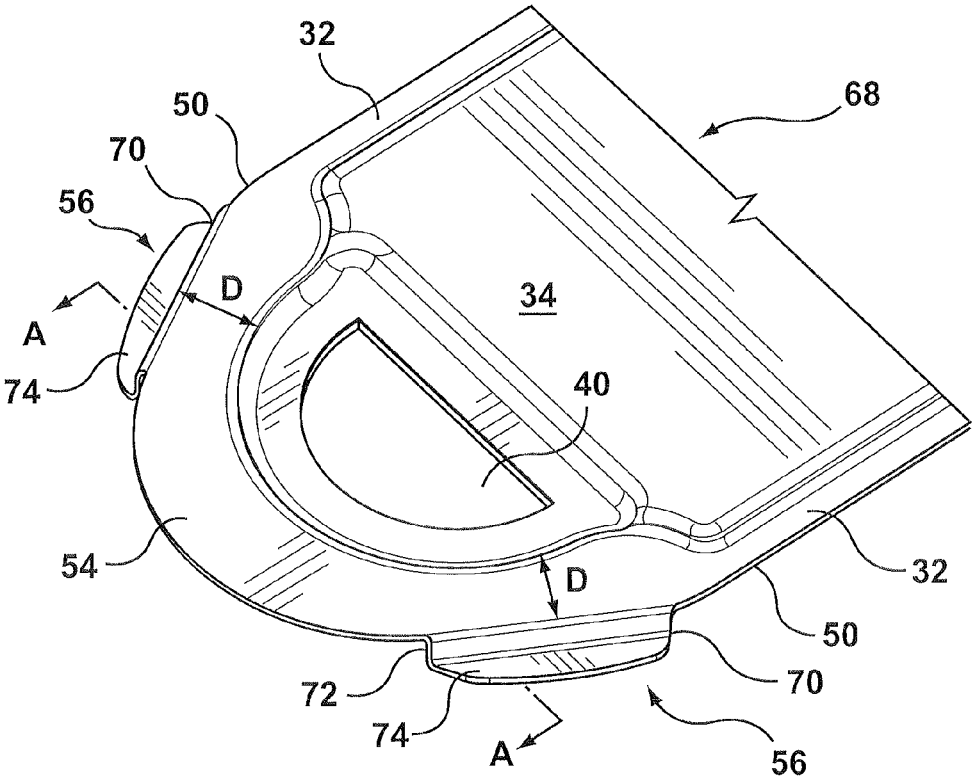
FIG. 10 is a partial perspective view of an end portion of a lower heat exchanger plate of a plate pair according to a preferred embodiment of the invention.
Figure 10A:
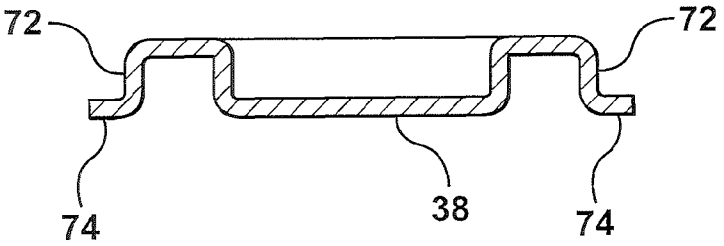
FIG. 10A is a cross-sectional view of the end portion of the heat exchanger plate shown in FIG. 10 taken along section line A-A.
Figure 11:
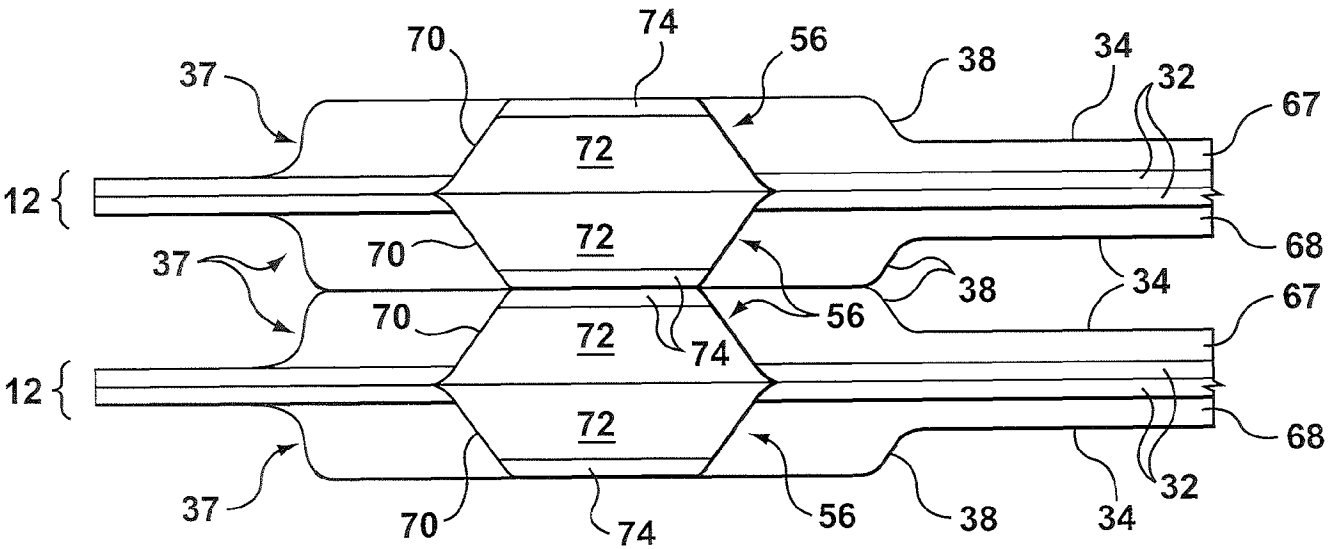
FIG. 11 is a partial elevation view of a subassembly of a heat exchanger according to the embodiment of the invention shown in FIG. 10.

FIGS. 10, 10A and 11 show the end portion of a heat exchanger according to a preferred embodiment of the invention. In this embodiment, the heat exchanger 10 is comprised of first and second plates 67, 68 (see FIG. 11) which are stacked face-to-face to each other to form plate pairs 12 which make up the core of the heat exchanger 10. First and second plates 67, 68 are similar in structure to plates 18, 19 described above, except for the protrusion members 56 which are in a different form than the previously described half-dimple protrusion members 57. Accordingly, in each plate pair 12, the second plate 68 is upside down with respect to the first plate 67 (see FIG. 11). FIG. 10 shows the second plate 68 of a plate pair 12 in more detail, while FIG. 10A shows a cross-sectional view of the end portion of plate 68.

As in the embodiments described above, the plate 68 has peripheral edge portion 32 and central planar portion 34 which, for this plate, projects below the plane of the peripheral edge portion 32. As in the previously described embodiments, the manifold members 37 that space the plate pairs 12 apart and establish fluid communication between the fluid channels 36 formed therein are in the form of spaced-apart end bosses 38 (only one shown) formed at either end of the central planar portion 34 of the plate 68 and extend out of the plane thereof. The end bosses 38 have openings 40 formed therein for providing fluid access to the first set of fluid channels 36. In this embodiment, the peripheral edge portions 32 have protrusion members 56 in the form of stepped-flange extensions 70 extending from the outer edge 50 of the peripheral edge portion 32. The stepped-flange extensions 70 have a vertical portion 72 extending from the edge of the peripheral edge portion 54, and an outwardly extending flange portion 74 which is generally perpendicular to the vertical portion 72 and lies generally in the same plane as the manifold members 37 or end bosses 38. As FIG. 10 shows the open, second plate 68 of a plate pair 12, the vertical portion 72 of the stepped-flange extension 70 is shown as downwardly depending from the outer edge 50 of the plate 68. However, it will be understood that in the corresponding first plate 67 (FIG. 11), which is identical to plate 68 except for being upside down with respect thereto, the vertical portion 72 would extend upwardly from the peripheral edge portion 32. When the plates 68 are stacked together in their face-to-face relationship with the corresponding first plates 67, the flange portions 74 of protrusion members 56 formed on the adjacent plate pairs 12 align and come into surface-to-surface contact with each other to provide an additional brazing surface and support structure between the plate pairs 12 in proximity to the manifold region of the heat exchanger 10.

While the outwardly extending flange portion 74 of the stepped-flange extension 70 has been described as being generally perpendicular to the vertical portion 72, it has been found that forming the stepped-flange extensions 70 so that the flange portion 74 is slightly angled with respect to the vertical portion 72 so that they contact each other at their outer periphery when the plates 67, 68 are initially stacked together to form the plate pairs 12. The slightly angled flange portion 74, which is sometimes referred to as a sprung flange, will deform to a flat or perpendicular condition with respect to the vertical portion 72 under loading, which tends to increase the likelihood of forming a proper joint between the stacked plate pairs 12 when the plate pairs 12 are joined together.

Figure 20:
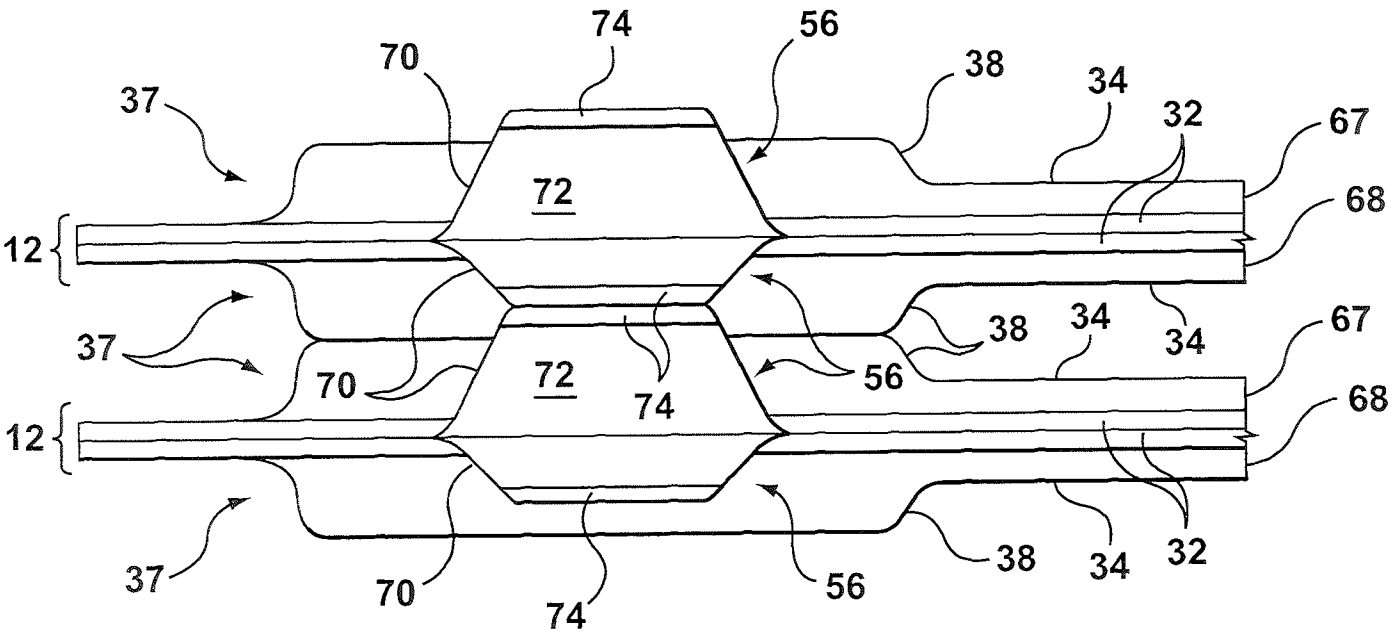
FIG. 20 is a variation of the embodiment of the heat exchanger subassembly shown in FIG. 11.

As well, the stepped-flange extensions 70 on the first and second plates 67, 68 have been shown in FIG. 11 as having vertical portions 72 that are of the same height, which height corresponds to the height of the end bosses 38. However, it will be understood that the stepped-flange extensions 70 on the first plates 67 could, instead, be formed so as to have vertical portions 72 that differ in height from the vertical portions 72 of the stepped-flange extensions 70 formed on the second plates 68 provided, of course, that once the plate pairs 12 are formed and are stacked together with the manifold members 37, the combined height of the stepped-flange extensions 70 corresponds to the distance between adjacent plate pairs 12 (see FIG. 20). It will also be understood that while this variation has been described in connection with protrusion members 56 in the form of stepped-flange extensions 70 it could be incorporated into any of the embodiments described herein. More specifically, the half-dimple 57 or elongated rib 66 protrusion members 56 on the first plates 18 of a plate pair could be formed with different heights than the corresponding protrusion members 56 formed on the second plates 19 provided that when the plate pairs 12 are stacked together, the protrusion members 56 on second plate 19 of a first plate pair 12 align and abut with the protrusion members 56 on the first plate 18 of the adjacent plate pair 12.

Incorporating protrusion members 56 in the form of stepped-flange extensions 70 is favourable not only for the advantage of providing additional support to the previously unsupported areas of the plate pairs, but this type of protrusion member 56 also tends to facilitate manufacturing processes and material requirements for producing heat exchanger plates incorporating the manifold strengthening protrusion.

Figure 13:
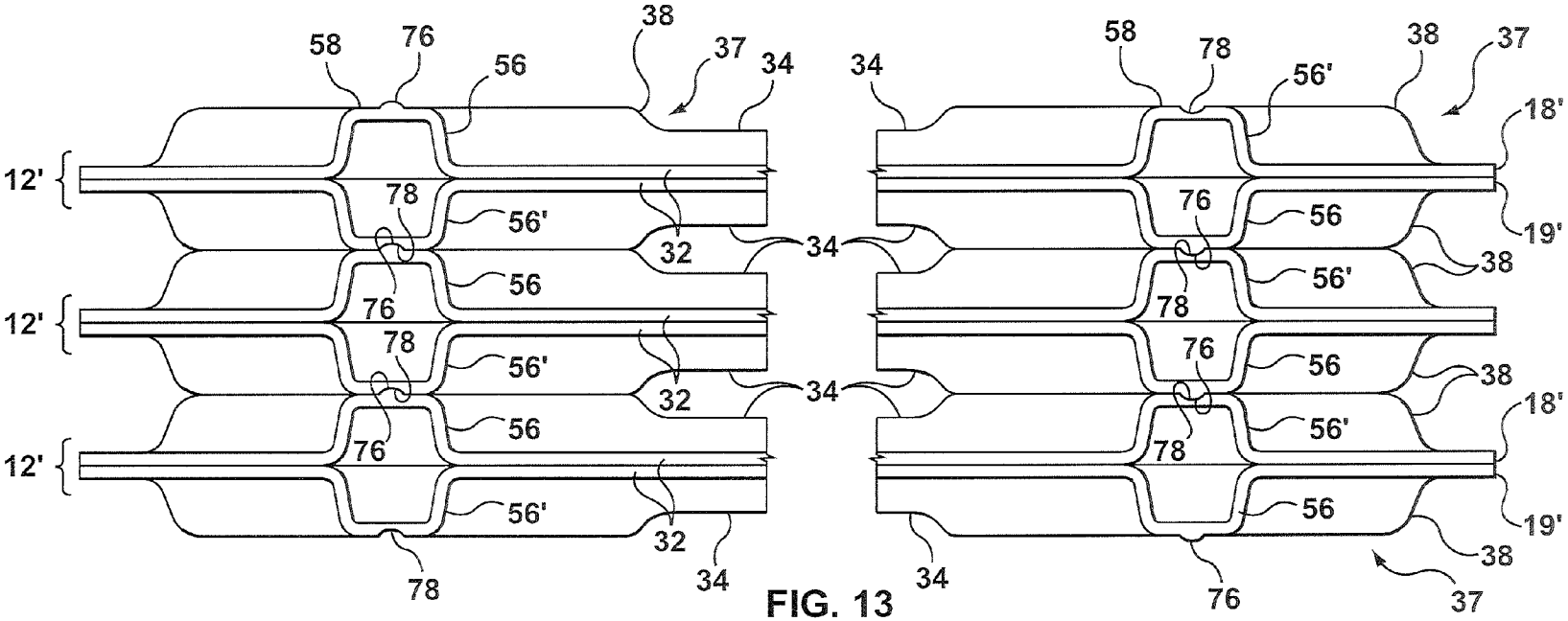
FIG. 13 is a partial elevation view of a subassembly of a heat exchanger according to another embodiment of the invention.

In yet another embodiment of the present invention, the protrusion members 56, whether they be in the form of half-dimples 57, ribs 66 or flange extensions 70, can be formed with corresponding locating features to facilitate the proper alignment of the plate pairs 12 when they are stacked together to form the heat exchanger 10. More specifically, as shown in FIG. 13, the plate pairs 12' are comprised of first and second plates 18', 19' which are similar in structure to the plates 18, 19 described in connection with the embodiment shown in FIG. 6. The first and second plates 18', 19' each have a central planar portion 34, a peripheral edge portion 32 and have manifold members 37 in the form of end bosses 38 formed at opposed ends of the plates 18', 19'. However, in this embodiment, the protrusion member 56 formed proximal to the manifold member 37 at one end of the first plate 18' is formed with a dimple or male locating feature 76 on its mating surface 58 while the protrusion member 56' formed proximal to the manifold member 37 at the opposite end of the plate 18' has a corresponding recess or female locating feature 78 formed on the mating surface thereof. The second plate 19' is identical in structure to the first plate 18' and, therefore, also has at least one protrusion member 56 formed with a male locating feature 76 at one end of the plate 19' and at least one protrusion member 56' formed at the opposite end of the plate 19' with a corresponding female locating feature 78. However, the second plate 19' is positioned upside-down and is rotated 180 degrees with respect to the first plate 18' when forming plate pairs 12'. Accordingly, when the plate pairs 12' are stacked together, the protrusion members 56', 56 on the second plate 19' of one plate pair 12' align with and abut the corresponding protrusion member 56, 56' on the first plate 18' of the adjacent plate pair 12' and the male locating features 76 mate with the corresponding female locating features 78 thereby locating one plate pair 12' with respect to the adjacent plate pair 12'. In addition to helping ensure that the plate pairs 12' are properly aligned, the inclusion of the locating features can also help to ensure that a good braze is achieved between the plate pairs 12'. While the dimples and recesses 76, 78 have only been shown incorporated into the half-dimple type of protrusion members 56, it will be understood that similar features could be incorporated into any of the protrusion member 56 designs described herein. Furthermore, while the male and female locating features 76, 78 have been described as being in the form of mating protrusions and dimples, it will be understood that locating features having any complimentary shape or geometry may be used. As well, the locating features may be designed to have a particular geometry or shape that ensures that sufficient contact or interference between the locating features is achieved when the plate pairs are stacked together, thereby ensuring that a proper seal or joint is achieved when the plate pairs are joined together, such as through brazing.

While the above-described embodiments of the present invention have been described in connection with heat exchangers formed mainly of stacked, flanged plates, the present invention can also be incorporated into heat exchangers having what is commonly referred to as a pan and cover design, as will be described in further detail below.

Figure 14:
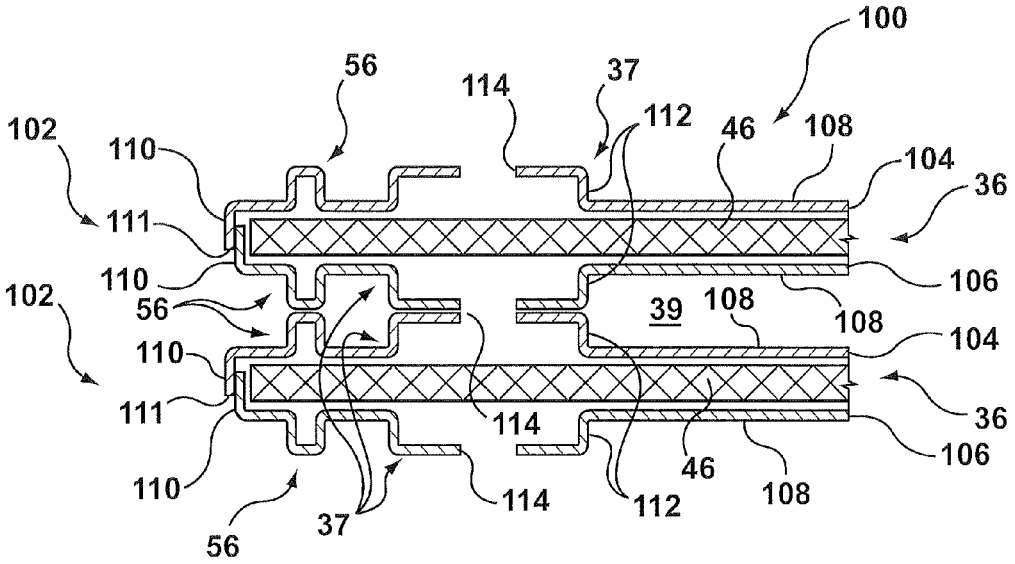
FIG. 14 is a partial elevation view of a subassembly of a heat exchanger according to another embodiment of the invention.

Referring now to FIG. 14, there is shown a partial elevation view of a subassembly of a pan and cover style heat exchanger 100 according to another embodiment of the invention taken along a section line (not shown) corresponding to the longitudinal axis of the heat exchanger 100. Heat exchanger 100 is similar in structure to the flanged plate heat exchangers described above in that it too is formed of a plurality of stacked plate pairs 102. Each plate pair 102 is identical to each other in that it is comprised of mating first and second plates 104, 106.

First plate 104 has a central planar portion 108 and a peripheral edge portion 110 extending around the periphery of the plate 104 from the central planar portion 108 to an outer edge 111 of the plate 104. In this embodiment, the peripheral edge portion 110 is downwardly depending with respect to the central planar portion 108 of the plate 104 and is substantially perpendicular thereto. Second plate 106 is similar in structure to the first plate 104 and, therefore, also has a central planar portion 108 and a peripheral edge portion 110 extending from the central planar portion 108 to the outer edge 111 of the plate 106. However, as second plate 106 is positioned upside down with respect to the first plate 104, the peripheral edge portion 110 projects upwardly with respect to the central planar portion 108 of the plate 106, as shown. Second plate 106 is formed so as to be slightly smaller in size than first plate 104. Therefore, when the plates 104, 106 are stacked together in their face-to-face relationship, the peripheral edge portion 110 of the first plate 104 fits over and overlaps the peripheral edge portion 110 of the second plate 106. Accordingly, the second plate 106 acts as the "pan" while the first plate 104 acts as the "cover" which gives rise to the heat exchanger configuration commonly referred to as a "pan and cover" style heat exchanger.

The surface contact between the peripheral edge portions 110 of the first and second plates 104, 106 creates a seal between the plates 104, 106 when they are joined or brazed together, thereby forming the first set of fluid channels 36 therebetween. As described in connection with the previous embodiments, a turbulizer 46 may be positioned inside the plate pairs 102 in fluid channels 36.

As with the embodiments described above, each plate 104, 106 is formed with manifold members 37 in the form of end bosses 112 located at the respective ends 110 of the first and second plates 104, 106. The end bosses 112 are raised out of the plane of the central planar portion 108 of the corresponding plate 104, 106 so that when the plate pairs 102 are stacked together the end bosses 112 space the adjacent plate pairs 102 apart forming the second set of flow channels 39 therebetween. Each end boss 112 has an opening 114 formed therein; therefore, when the plate pairs 102 are stacked together, the end bosses 112 and openings 114 align so as to define respective inlet and outlet manifolds. While the subject embodiment of the heat exchanger 100 has been shown having circular end bosses 112 with circular inlet/outlet openings 114, it will be understood that any shape of end boss or opening may be used, as desired.

Although not shown in the drawings, heat transfer enhancing devices such as cooling fins or turbulizers, for example, may be positioned in the second set of flow channels 39 between the plate pairs 102, as described above in connection with the previous embodiments.

Figure 15:
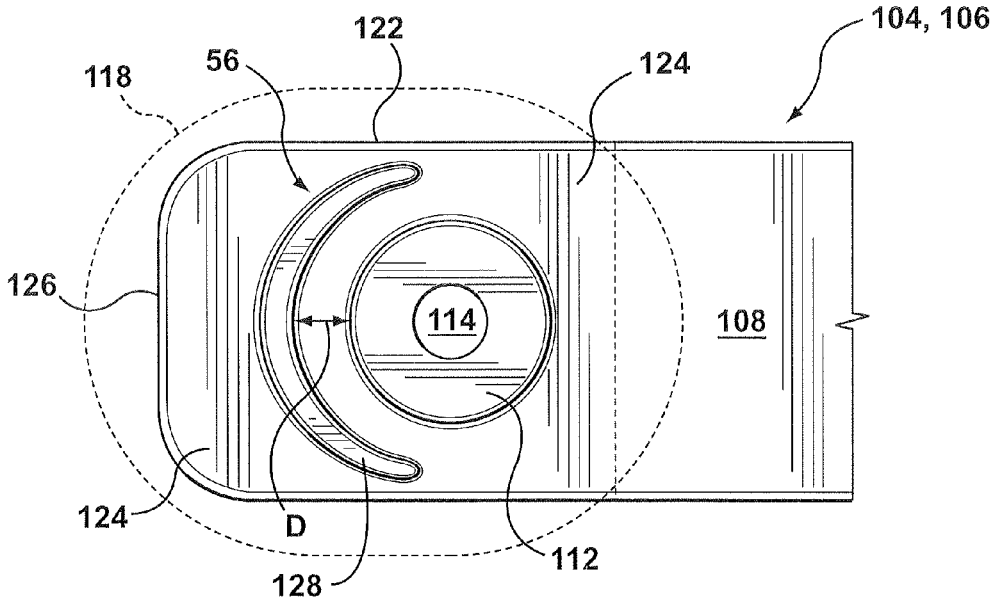
FIG. 15 is a top view of a heat exchanger plate used in the subassembly shown in FIG. 14.

The end bosses 112 are formed in the respective end portions 118, shown by the encircled area in FIG. 15, of the plates 104, 106 and are inwardly spaced from an outer boundary 122 of the central planar portion 108. Accordingly, in this embodiment, the central planar portion 108 has an end section 124 that extends around the end boss 112 to the outer boundary 122 and outer end 126 of the plate 104, 106.

A protrusion member 56 is formed in the end section 124 of the central planar portion 108 that extends around the end boss 112, the protrusion member 56 being appropriately spaced-apart from the end boss 112 by distance D. In the embodiment shown, the protrusion member 56 is in the form of a curvilinear rib 128 that projects out of the plane of the central planar portion 108, 124 and, generally corresponds to the shape of the end boss 112. When the plate pairs 102 are stacked together, the protrusion member 56 or rib 128 on the second plate 106 of a first plate pair 102 aligns with and comes into surface-to-surface contact with the protrusion member 56 or rib 128 on the first plate 104 of the adjacent plate pair 102. As with the embodiments discussed above, the mating of the protrusion members 56 or ribs 128 provide an additional area of surface contact between the adjacent plate pairs 102 proximate to the manifold regions, which area would otherwise be unsupported leaving the manifold regions susceptible to deformation (i.e. accordion or bellows-like deformation) when subjected to high pressure cycles.

While the above-described embodiments of the present invention have been described in connection with heat exchangers formed mainly of stacked plate pairs 12, 12', 102 with manifold members 37 in the form of end bosses 38, 112 integrally formed in the plates, the present invention can also be incorporated into heat exchangers wherein the manifold members 37 are in the form of thin washers or tubular members, as will be described in detail below in connection with FIGS. 17-19.

Figure 17:
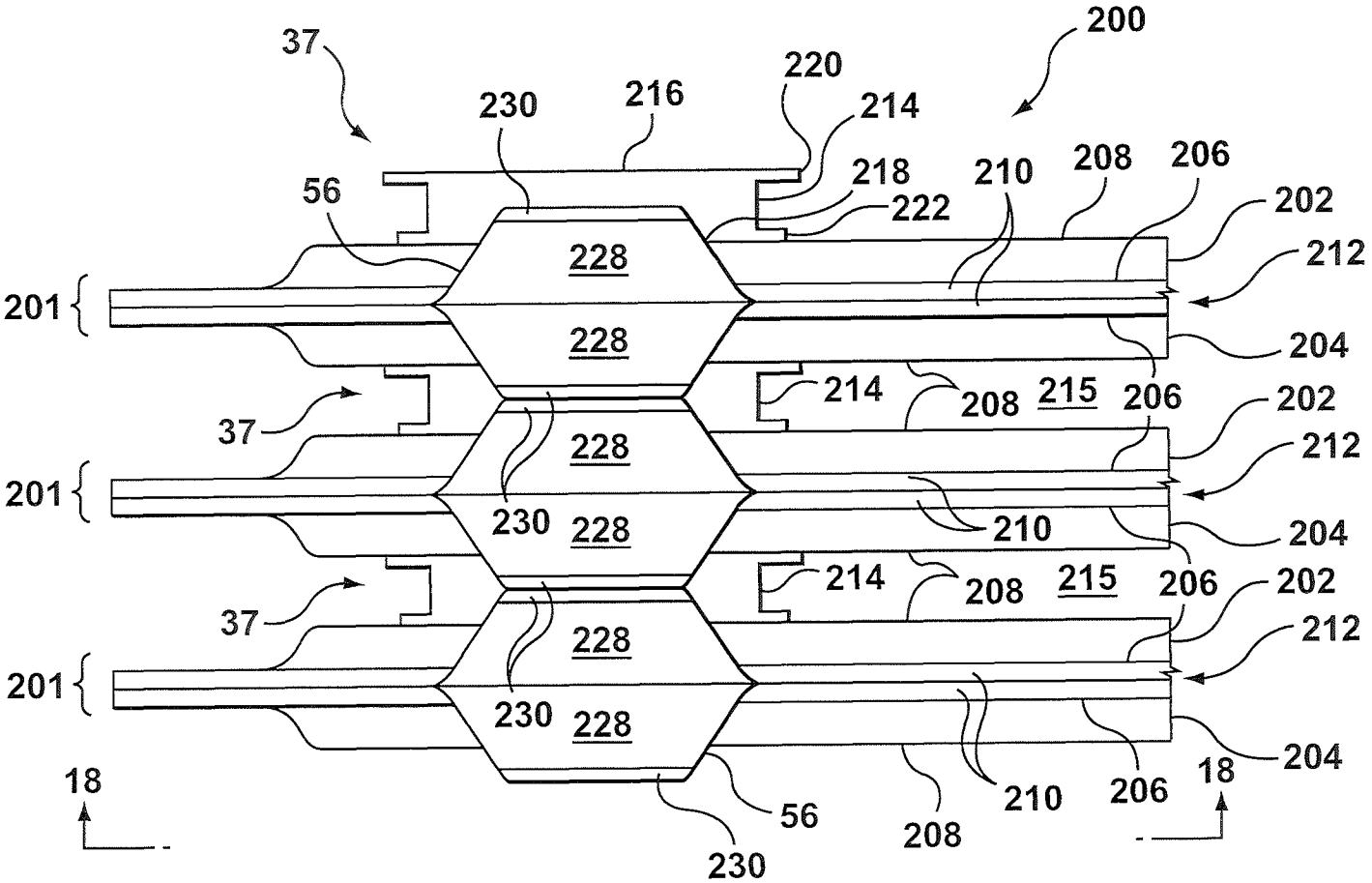
FIG. 17 is a partial elevation view of a subassembly of a heat exchanger according to another embodiment of the invention.

Referring now to FIG. 17 there is shown a subassembly of a heat exchanger 200 according to another embodiment of the invention. Heat exchanger 200 is similar in structure to the heat exchangers 10, 100 described above in that it too is formed of a plurality of stacked plate pairs 201 made up of first and second plates 202, 204. In the subject embodiment, each plate 202, 204 has a peripheral edge portion 206 and a raised central planar portion 208 that projects out of the plane of the peripheral edge portion 206, the peripheral edge portion 206 extending from the central planar portion to an outer edge 210 of the plate 202, 204. As with the previously described embodiments, the second plate 204 is arranged upside down with respect to the first plate 202; therefore, the central planar portion 208 of the second plate 204 is seen as projecting below the peripheral edge portion 206. When the plates 202, 204 are arranged in their face-to-face relationship to form plate pairs 201, the peripheral edge portions 206 of the plates 202, 204 join together forming a seal, thereby defining a first set of fluid channels 212 between the spaced-apart central planar portions 208 of the plates 202, 204. As with the previously described embodiments, a turbulizer 46 (see FIG. 18) or any other heat transfer enhancing device may be located within the first set of fluid channels 212.

When the plate pairs 201 are stacked together to form the heat exchanger 200, they are spaced-apart from each other by manifold members 37 in the form of tubular members 214. The tubular members 214 space-apart the plate pairs 201 thereby forming a second set of fluid channels 215 between the adjacent plate pairs 201, the second set of fluid channels 215 being transverse to the first set of fluid channels 212 formed by plate pairs 201. The tubular members 214 are positioned at opposed ends of the plates 202, 204. Each tubular member 214 has first and second open ends 216, 218 having flanged end edges 220, 222, respectively (see FIG. 19). In the embodiment shown, the flanged end edge 220 of the first end 216 of the tubular member 214 is shown as being larger in diameter than the flanged end edge 222 of the second end 218. However, it will be understood that the tubular member 214 could instead be formed with flanged end edges 220, 222 that are of the same overall diameter.

Figure 18:
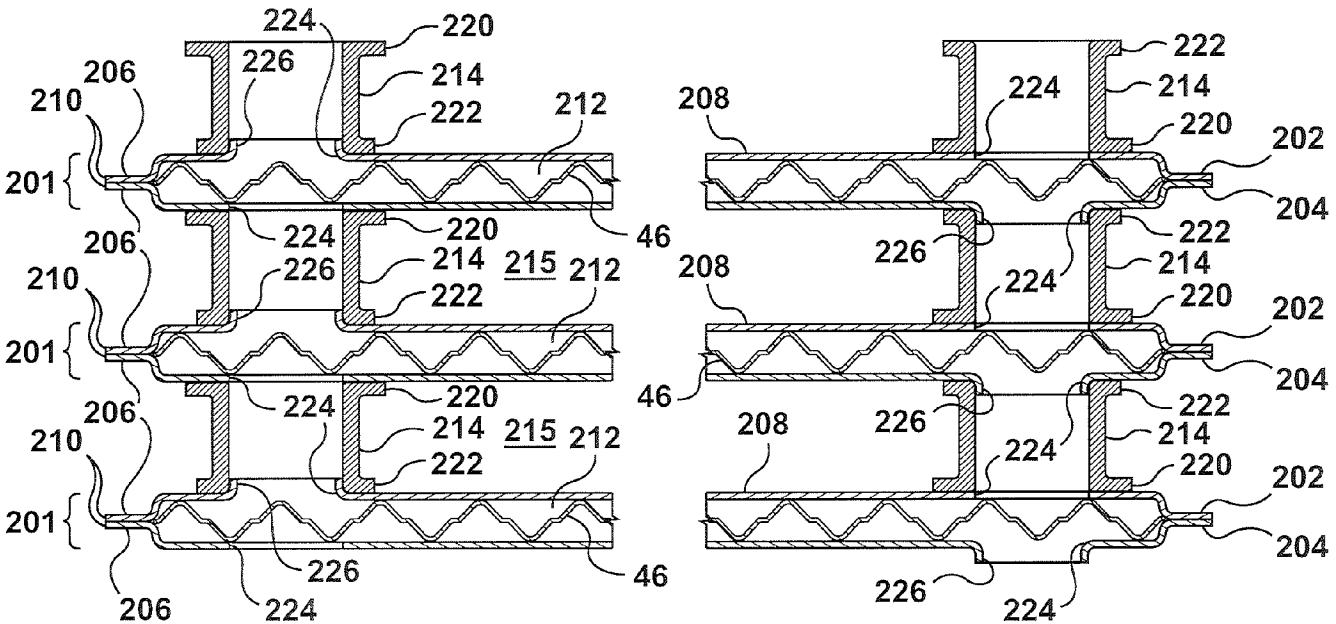
FIG. 18 is a cross-sectional view of the heat exchanger subassembly shown in FIG. 17 taken along section line 18-18.
Figure 19:
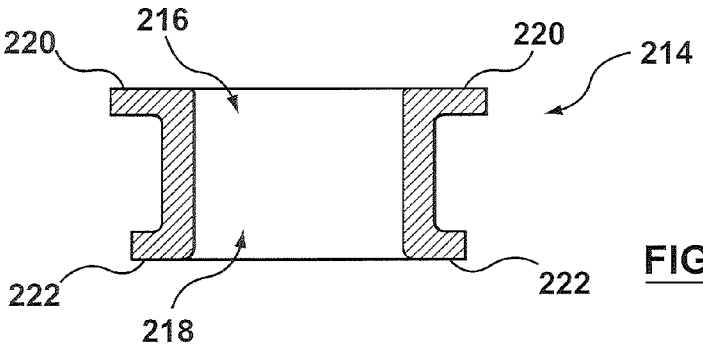
FIG. 19 is a cross-sectional view of a manifold member used in the heat exchanger of FIGS. 17 and 18.

As best seen in FIG. 18, which shows a cross-sectional view of the heat exchanger subassembly shown in FIG. 17 taken along section line 18-18, when the plate pairs 201 are stacked together, the manifold members 37 cooperate with respective inlet/outlet openings 224 formed in the central planar portions 208 of the plates 202, 204. The inlet/outlet openings 224 provide fluid access to the first set of fluid channels 212 for the flow of a first fluid through the heat exchanger 200. At least one of the openings 224 on each plate 202, 204 has a raised lip portion 226 formed around the edge thereof while the other of the openings is flush with the surface of the central planar portion 208 of the plate 202, 204. The lip portion 226 projects out of the plane of the central planar portion 208, and has an external diameter that is slightly smaller than the interior diameter of the corresponding first or second end 216, 218 of the tubular member 214. Accordingly, when the plate pairs 201 and tubular members 214 are stacked together, the tubular members 214 positively engage the lip portion 226 of the at least one inlet/outlet opening 224, and the flanged end edges 220, 222 allow the tubular members 214 to sit on the surface of the central planar portion 208 of the corresponding plate 202, 204. The flanged edges 220, 222 provide adequate surface contact between the tubular members 214 and the plates 202, 204 to ensure that a proper seal or joint is formed between the components when they are brazed or otherwise joined together to form the heat exchanger 200. As well, the positive engagement between the tubular members 214 and the lip portions 226 on the first and second plates 202, 204 ensures that the tubular members 214 are in proper alignment with the inlet/outlet openings 224 formed in the plates 202, 204 and that proper fluid communication is established between the first set of fluid channels 212.

As with the previously described embodiments, first and second plates 202, 204 are identical to each other with the second plate 204 being inverted and, in some embodiments, rotated 180 degrees with respect to the first plate 202. In the embodiment shown in FIGS. 17 and 18, only one of the inlet/outlet openings 224 is shown as having a raised lip portion 226 formed around the edge thereof while the other of the openings 224 is flush with the surface of central planar portion 208 of the plate 202, 204. Accordingly, in this embodiment the second plate 204 is positioned upside down and is rotated 180 degrees with respect to the first plate 202, as shown in FIG. 18. As well, since the tubular members 214 described in connection with this embodiment have a first end 216 with a flanged end edge 220 that is larger than the flanged end edge 222 associated with the second end 218 of the tubular member 214, which end is intended to cooperate with the inlet/outlet opening 224 that is flush with the surface of the central planar portion 208, the tubular members 214 located at one end of the plate pairs 201 are oriented in a first direction while the tubular members 214 located at the opposed end of the plate pairs 201 are oriented upside down with respect to the first direction.

While the subject embodiment has been shown as having only one inlet/outlet opening 214 formed with a raised lip portion 226 and as employing tubular members 214 having a second end 218 adapted to cooperate with the raised lip portion 226, it will be understood that if both the inlet and outlet openings 224 are formed with raised lip portions 226, the tubular member 214 could be formed with identical first and second ends 216, 218, and the second plate 204 would simply be turned upside down with respect to the first plate 202 rather than having to also be rotated 180 degrees with respect thereto.

Referring again to FIG. 17, and as described in connection with the previous embodiments, first and second plates 202, 204 are formed with a protrusion member 56 associated with the peripheral edge portions 206 of the plates 202, 204. In the subject embodiment, the protrusion member 56 is similar in structure to the stepped-flange protrusion member described in connection with FIGS. 10 and 11. Accordingly, in this embodiment, the protrusion member 56 also includes a vertical portion 228 extending from the end edge of the peripheral edge portion 206, and an outwardly extending flange portion 230 that extends substantially perpendicular to the vertical portion 228. When the plates 202, 204 are stacked together in their face-to-face relationship, the flange portions 230 of the protrusion members 56 on the adjacent plate pairs 201 align and come into surface-to-surface contact with each other. This surface-to-surface contact provides an additional brazing surface between the plate pairs 201 in the proximity of the manifold region which in turn provides additional support in a traditionally unsupported area of the plate pairs 201. The additional support provided by the stepped-flange protrusion member 56 not only helps to prevent the manifold regions of the heat exchanger 200 from distorting under high fluid pressures, but also allows for the tubular members 214 to be made from relatively thinner gauge material, thereby reducing the overall manufacturing costs associated with the heat exchanger 200.

While the protrusion member 56 in the subject embodiment has been described as being in the form of a stepped-flange extension, it will be understood that any of protrusion members 56 described in connection with the previous embodiments may be incorporated into the subject design. More specifically, the protrusion member 56 may be in form of a half-dimple, a rib, a stepped-flange or flange extension, etc. and may have either flat or rounded mating surfaces.

Furthermore, it will be understood that cooling fins (not shown) could be located in the second set of flow channels 215 formed between the plate pairs 201. As with the previous embodiments, any type of cooling fin could be used, as desired. As well, the turbulizer 46 located in the first set of fluid channels 212 is shown as extending the entire length of the fluid channels 212, the turbulizer 46 could instead have a length corresponding to the distance provided between the openings 224 formed in the plates 202, 204 so as to prevent any pressure drop that may be associated with the first fluid entering the first set of fluid channels 212.

In a typical application, the components of heat exchanger 10, 100, 200 are made of brazing clad aluminum (except for the peripheral components such as fittings 28, 30). In general, the brazing clad aluminum that is typically used for heat exchanger plates have a metal thickness between in the range of about 0.012 inches (0.030 cm) and about 0.040 inches (0.102 cm). While it is desirable to use as thin a gauge material as possible since thinner gauge material tends to braze better and decreases the overall weight of the device, thinner gauge material has less mechanical strength than thicker materials, especially after brazing. Therefore, the use of thinner gauge material is limited by the specific strength requirements of the heat exchanger plates.

In heat exchanger 10, 100, 200 however, it has been found that the additional brazing surface provided by the protrusion members 56 increases the overall strength of the heat exchanger 10, 100, 200 so that thinner gauge material may be used to form the heat exchanger plates without compromising their inherent strength. More specifically, it has been found that plates manufactured out of thinner gauge material, such as 0.020 inches (0.051 cm), offer the equivalent or even better mechanical durability than plates that are made out of a thicker gauge material, i.e. 0.029 inches (0.074 cm). Accordingly, the heat exchanger 10, 100, 200 of the present invention can be made of thinner gauge material, thereby increasing the likelihood of achieving a good braze and reducing the overall weight of the heat exchanger 10, 100, 200 without compromising the overall strength and durability of the device. Plate thickness, therefore, tends to be in the range of about 0.012 inches (0.030 cm) to about 0.039 inches (0.099 cm), although plates having a thickness in the range of about 0.016 inches (0.041 cm) to about 0.020 inches (0.051 cm) are preferred.

In one application, heat exchanger 10, 100, 200 is used as an in-tank engine or transmission oil cooler. Typically, in-tank oil coolers are mounted inside the cold tank of the radiator of the vehicle. Engine or transmission oil flows through the closed circuit of fluid channels 36, 212 through the heat exchanger 10, 100, 200 as the first fluid, while the water or coolant, which flows through the radiator, flows around and through the second set of flow channels 39, 215 formed between the plate pairs 12, 12', 60, 61, 102, 201 as the second fluid through heat exchanger 10, 100, 200. A difficulty that is sometimes encountered with in-tank oil coolers is that the liquid flowing around the heat exchanger 10, 100, 200 does not always flow through the flow channels 39, 215 between the plate pairs (i.e. through the core of the heat exchanger 10) but tends to by-pass the core and flow around the end portions 48, 118 of the heat exchanger 10, 100, 200 thereby decreasing the overall performance of the heat exchanger 10, 100, 200. The inclusion of the protrusion members 56 in the periphery of the plate pairs 12, 12', 60, 61, 102, 201, however, tends to decrease this type of by-pass flow by helping to block the flow of fluid around the periphery of the plate pairs 12, 12', 60, 61, 102, 201 and encouraging the fluid to through the flow channels 39, 215 between the individual plate pairs 12, 12', 60, 61, 102, 201.

Having described the preferred embodiments of the invention, it will be appreciated that various modifications may be made to the structures described without departing from the spirit or scope of the invention described herein. For instance, while the plates 18, 19, 67, 68, 104, 106, 202, 204 have been shown as having flat central planar portions 34, 108, 208 with a fin or turbulizer 46 located therebetween, the central planar portions may instead be formed with inwardly disposed surface protrusions (not shown), such as dimples or ribs for example, which are spaced uniformly over the surface thereof. The inwardly disposed surface protrusions not only provide additional support to the central planar portions 34 which helps to prevent the central planar portions from sagging when the plates are heated to brazing temperatures, the inwardly disposed surface protrusions also create turbulence in the fluid flowing through the fluid channels formed inside the plate pairs 12.

Figure 16:
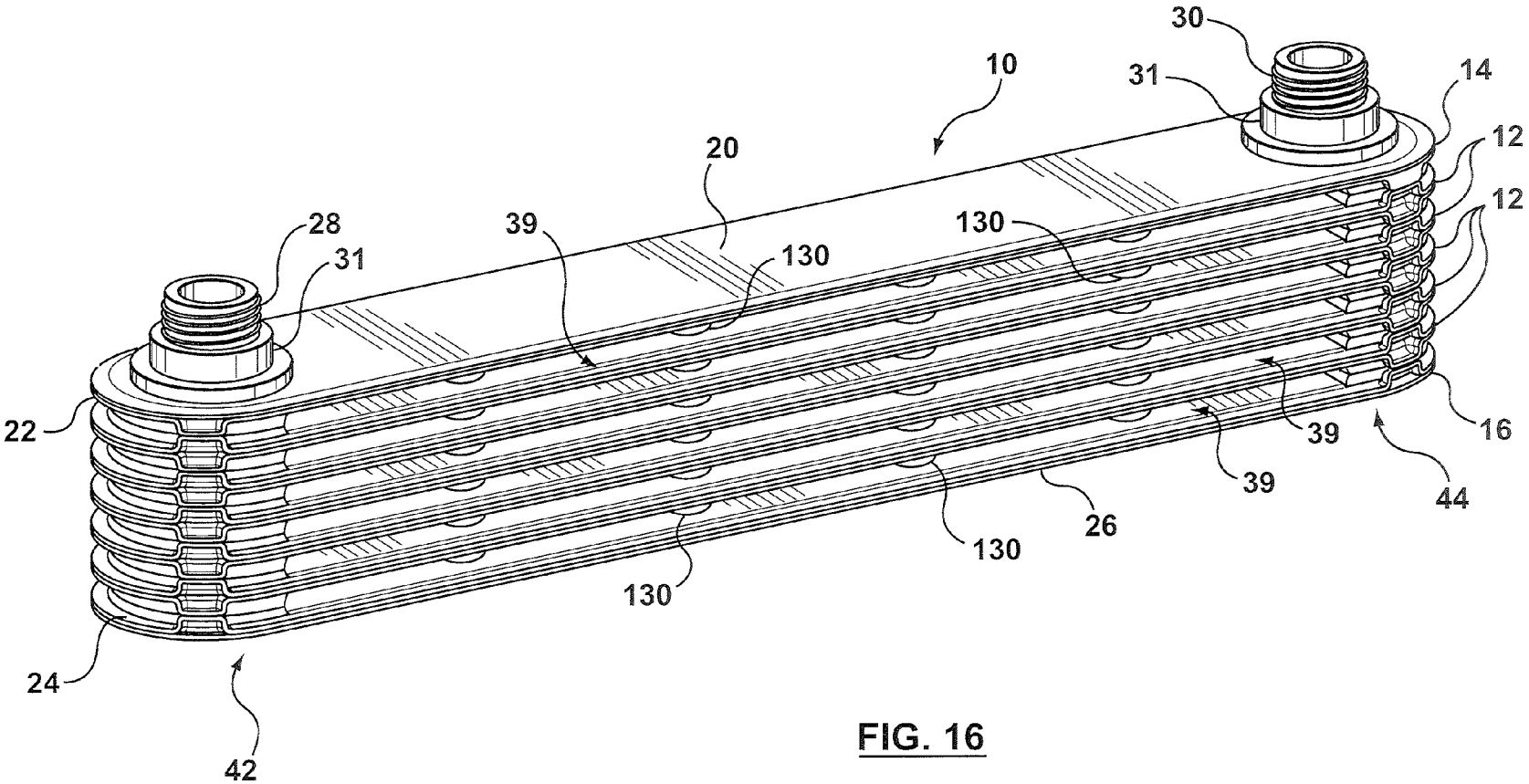
FIG. 16 is a perspective view of an embodiment of the heat exchanger according to another embodiment of the present invention.

As well, rather than having inwardly disposed surface protrusions formed in the central planar portions 34, 108, 208 of the plates, the plates may instead be formed with outwardly disposed surface protrusions 130 (in the form of dimples or ribs for example) which are spaced uniformly over the surface thereof, as shown in FIG. 16. As the plate pairs are stacked together to form the heat exchanger, the outwardly disposed surface protrusions 130 on the second plate of one plate pair align and mate with the outwardly disposed surface protrusions 130 formed in the first plate of the adjacent plate pair. The outwardly disposed surface protrusions 130 provide additional support to the central planar portions 34, 108, 208 of the plates 18, 19, 62, 64, 104, 106, 202, 204 and also serve to enhance heat transfer by increasing turbulence in the flow of the second fluid through the second set of fluid channels 39, 215 formed between adjacent plate pairs without requiring the need for a separate fin or turbulizer. A turbulizer, however, may still be used between the plates of each plate pair to create turbulence in the first set of fluid channels 36, 212.

Furthermore, while the heat exchanger 10, 100, 200 has been described as being made of aluminum, heat exchanger 10, 100, 200 can be made from other materials such as stainless steel, brass, or even a non-metallic material. In the case of stainless steel, a brazing cladding layer or copper could be used to ensure a proper seal is created between the stacked plates. As well, the length of the heat exchanger plates can be made to any length suitable for a desired application, and any number of plate pairs 12, 60, 61, 102, 201 may be used to create a heat exchanger 10, 100, 200 of the desired dimensions.

We claim:

1. A heat exchanger comprising a plurality of stacked plate pairs, each plate pair having a first plate and a second plate, and the first plate in face-to-face contact with the second plate;

the first plate comprising:

a first plate longitudinal central planar portion and a first plate peripheral edge portion extending from the central planar portion, the central planar portion in a plane above the peripheral edge portion;

first plate inlet and outlet manifold members at opposed ends of the longitudinal central planar portion, each of the manifold members comprising:

a boss having an inlet or outlet opening;

a flange extending from the boss to an outer edge, the flange of the manifold member being in the same plane as the peripheral edge portion; and a protrusion member having a mating surface and extending from the flange or outer edge, and the protrusion member extending above from the plane of the flange;

the second plate comprising:

a second plate longitudinal central planar portion and a second plate peripheral edge portion extending from the central planar portion, the central planar portion in a plane below the peripheral edge portion;

second plate inlet and outlet manifold members at opposed ends of the longitudinal central planar portion, each of the manifold members comprising:

a boss having an inlet or outlet opening;

a flange extending from the boss to an outer edge, the flange of the manifold member being in the same plane as the peripheral edge portion; and a protrusion member having a mating surface and extending from the flange or outer edge, and the protrusion member extending below from the plane of the flange;

wherein:

the first plate peripheral edge portion is in contact with the second plate peripheral edge portion to form the plate pair, and the central planar portions and the peripheral edge portions of the first and second plates together define a first set of fluid channel, the first set of fluid channel in fluid communication with the inlet and outlet manifold members;

the manifold members of the plate pair spacing apart said plate pair from an adjacent plate pair; and the mating surface of the protrusion member of the first plate in contact with the mating surface of the protrusion member of a second plate on the adjacent plate pair.

2. The heat exchanger as claimed in claim 1, wherein the protrusion members are in the form of a rib projecting out of the plane of the peripheral edge portion of said first and second plates.

3. The heat exchanger as claimed in claim 1, wherein the protrusion members are in the form of a half-dimple formed in the outer edge of the peripheral edge portion of said first and second plates, said half-dimple having a substantially planar surface corresponding to said mating surface.

4. The heat exchanger as claimed in claim 3, wherein the mating surface of said half-dimple protrusion member is slightly convex prior to joining of the plate pairs.

5. The heat exchanger as claimed in claim 1, wherein the protrusion members are in the form of flange extensions, said flange extensions having a vertical portion extending substantially perpendicular from the outer edge of the peripheral edge portions, and a flange portion extending outwardly and away from said vertical portion, said flange portion corresponding to said mating surface.

6. The heat exchanger as claimed in claim 1, wherein a protrusion member is formed on either side of each of end bosses of the first and second plates.

7. The heat exchanger as claimed in claim 1, wherein a plurality of protrusion members are formed around an outermost end of each of end bosses on the first and second plates.

8. The heat exchanger as claimed in claim 1, wherein the peripheral edge portion of said first plate is downwardly depending and in a plane substantially perpendicular to the central planar portion of said first plate, and the peripheral edge portion of said second plate projects upwardly from and is in a plane substantially perpendicular to the plane of the central planar portion of said second plate, the peripheral edge portion of said first plate overlapping and mating with the peripheral edge portion of said second plate.

9. The heat exchanger as claimed in claim 1, wherein the manifold members are in the form of opposed end bosses integrally formed in each of said first and second plates, said end bosses projecting out of the plane of the central planar portion and having respective inlet and openings formed therein.

10. The heat exchanger as claimed in claim 1, further including a turbulizer located in said first set of fluid channels formed between said spaced-apart central planar portions of said first and second plates.

11. The heat exchanger as claimed in claim 1, further including cooling fins located in the second set of fluid channels formed between the adjacent plate pairs.

12. The heat exchanger as claimed in claim 1, wherein said first and second plates are made from sheets of brazing clad aluminum having a thickness in the range of about 0.012 to about 0.039 inches.

13. The heat exchanger as claimed in claim 12, wherein the thickness of the sheets of brazing clad aluminum is in the range of about 0.016 to about 0.020 inches.

14. The heat exchanger as claimed in claim 1, wherein said first and second plates are made from a non-metallic material.

* * * * *

UNITED STATES PATENT AND TRADEMARK OFFICE

CERTIFICATE OF CORRECTION

PATENT NO. : 8,678,076 B2
APPLICATION NO. : 11/941353
DATED : March 25, 2014
INVENTOR(S) : Christopher R. Shore et al.

It is certified that error appears in the above-identified patent and that said Letters Patent is hereby corrected as shown below:

ON THE TITLE PAGE ITEM (73) SHOULD READ
Dana Canada Corporation, Oakville, Ontario (CA)

Signed and Sealed this
Sixteenth Day of February, 2016

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 8,678,076 B2
APPLICATION NO. : 11/941353
DATED : March 25, 2014
INVENTOR(S) : Christopher R. Shore et al.

It is certified that error appears in the above-identified patent and that said Letters Patent is hereby corrected as shown below:

ON THE TITLE PAGE

Item (76) should be changed to Item (75)

Item (73) should read Dana Canada Corporation, Oakville, Ontario (CA)

This certificate supersedes the Certificate of Correction issued February 16, 2016.

Signed and Sealed this
Thirty-first Day of May, 2016

Michelle K. Lee

Michelle K. Lee
*Director of the United States Patent and Trademark Office*